US008021207B2

(12) United States Patent
Manrique

(10) Patent No.: US 8,021,207 B2
(45) Date of Patent: Sep. 20, 2011

(54) CHILD'S STORYBOOK PLAY STRUCTURE

(76) Inventor: Anne L. Manrique, Los Angeles, CA (US)

( * ) Notice: Subject to any disclaimer, the term of this patent is extended or adjusted under 35 U.S.C. 154(b) by 208 days.

(21) Appl. No.: 12/338,047

(22) Filed: Dec. 18, 2008

(65) Prior Publication Data

US 2009/0104838 A1 Apr. 23, 2009

Related U.S. Application Data

(63) Continuation-in-part of application No. 10/985,683, filed on Nov. 12, 2004, now Pat. No. 7,467,985.

(51) Int. Cl.
*A63H 33/38* (2006.01)
*A63H 33/00* (2006.01)

(52) U.S. Cl. ..... 446/147; 446/149; 446/108

(58) Field of Classification Search ..... 446/62, 446/107–111, 147–150, 136, 487, 476, 478, 446/403; 434/403, 408
See application file for complete search history.

(56) References Cited

U.S. PATENT DOCUMENTS

| | | | | |
|---|---|---|---|---|
| 984,735 | A | 2/1911 | Bailey | |
| 2,032,531 | A * | 3/1936 | Eaton | 446/80 |
| 2,084,308 | A * | 6/1937 | Behr | 273/287 |
| 2,183,443 | A * | 12/1939 | Bracker | 446/80 |
| 3,363,360 | A | 1/1968 | Ryan | |
| 3,434,233 | A * | 3/1969 | Silverstein et al. | 446/80 |
| 3,452,989 | A | 7/1969 | Jernstrom | |
| 3,471,962 | A | 10/1969 | Klein | |
| 4,212,130 | A | 7/1980 | Walker | |
| 4,764,142 | A | 8/1988 | Griffith et al. | |
| 4,793,286 | A | 12/1988 | Buxton | |
| 4,946,414 | A | 8/1990 | Zimmer | |
| 5,004,445 | A | 4/1991 | Coleman et al. | |
| 5,014,455 | A | 5/1991 | Desaderata | |
| 5,069,623 | A | 12/1991 | Peat | |
| 5,085,609 | A | 2/1992 | Haberle | |
| 5,096,204 | A | 3/1992 | Lippman | |
| 5,219,316 | A | 6/1993 | Huffman | |
| 5,352,149 | A | 10/1994 | Melashenko et al. | |
| 5,487,690 | A | 1/1996 | Stoffle et al. | |
| 5,491,950 | A | 2/1996 | Obegi | |
| 5,525,088 | A | 6/1996 | Mayne | |
| 5,540,609 | A | 7/1996 | Hoag | |
| 5,542,870 | A | 8/1996 | Westersund | |
| 5,577,465 | A | 11/1996 | Cook | |
| 5,706,613 | A | 1/1998 | Drake, Jr. et al. | |
| 5,733,165 | A | 3/1998 | Kelley | |
| 5,775,969 | A | 7/1998 | Pedersen | |
| 5,961,149 | A | 10/1999 | Hunt | |
| 6,068,556 | A | 5/2000 | Bernstein | |
| 6,071,174 | A | 6/2000 | Yoon | |
| 6,210,172 | B1 | 4/2001 | Clements | |
| 6,419,493 | B1 | 7/2002 | Cole | |

(Continued)

*Primary Examiner* — Kien Nguyen
(74) *Attorney, Agent, or Firm* — Kelly Lowry & Kelley, LLP

(57) ABSTRACT

A storybook kit for a child's play structure includes poles removably attached to one another and arranged to form a three-dimensional box-like structure of a size to permit a child to fully enter therein. A plurality of panels are attached to the poles. The panels have graphic representations thereon corresponding to at least a portion of a story or illustration depicted in an accompanying storybook. Three dimensional objects may be positionable within, or removably attached to the panels, and which correspond to objects in the storybook to enhance the play experience. Multiple structures may be placed side-by-side so that a child can move from one structure to another, and thus from one portion of the story to the next.

22 Claims, 11 Drawing Sheets

U.S. PATENT DOCUMENTS

| | | | |
|---|---|---|---|
| 6,506,093 | B2 | 1/2003 | Avital |
| 6,560,095 | B1 | 5/2003 | Zheng |
| 6,694,994 | B1 | 2/2004 | Zheng |
| 6,905,338 | B1 | 6/2005 | Garran |
| 7,014,524 | B2 | 3/2006 | Farmer Brock et al. |
| 2006/0040582 | A1 | 2/2006 | Hopper et al. |

* cited by examiner

CHILD'S STORYBOOK PLAY STRUCTURE

BACKGROUND OF THE INVENTION

The present invention generally relates to the field of children's play structures. More particularly, the present invention relates to a storybook kit for a child's play structure, and related method of assembling the same.

It has been a tradition for hundreds of years to tell stories to young children as part of a child's learning process. Originally stories were told orally and passed from one generation to the next. More recently, printed storybooks have become very popular as a means of telling stories to children. Traditional children's books consist of painted or drawn pictures printed on two dimensional pages and combined with text. Pop-up flaps have been included in some new books to add some three dimensionality to the story telling experience. However, the concept of providing a large scale three dimensional representation for a story has not been developed to date.

Others have proposed structures that help a child participate in creative play such as U.S. Pat. No. 3,363,360 which discloses a doll house structure that includes additions to the walls that can represent parts of a house such as a kitchen stove. U.S. Pat. No. 5,733,165 discloses a play structure that includes additional play figures that relate to play surfaces on the interior of the structure. U.S. Pat. No. 5,004,445 discloses a series of shapes of home furniture and kitchen appliances, that when opened, reveal a miniature environment relating to that particular item. For example, the side of a play bed structure can fold out to reveal an entire miniature bedroom. U.S. Pat. No. 5,352,149 discloses a children's play structure with interchangeable scenes. This patent shows a play structure where graphic elements can be added to the interior walls adapting the space to a classroom, or a kitchen, or the like.

However, none of the above-described patents, or other patents in this category, describe a novel approach to story telling where a portion of a play structure represents a page or pages of a storybook and by crawling or walking from one play structure to the next, a child can travel through a story in a three dimensional manner.

Accordingly, there is a continuing need for a novel approach to story telling, which incorporates a play structure which represents the story or illustrations within the storybook, and enable the child to crawl, walk, or otherwise play within the structure so as to mimic and play out themes of the story. The present invention fulfills these needs, and provides other related advantages.

SUMMARY OF THE INVENTION

The present invention resides in a storybook kit for a child's play structure. The invention allows a child to experience a storybook page, story, or illustration in a three dimensional format.

The kit generally comprises a storybook having a plurality of pages including a written story and at least one illustration. Poles are removably attached to one another and arranged to form a three-dimensional box-like structure of a size to permit a child to fully enter therein. A plurality of panels are attached to the poles. At least one of the panels has graphic representations thereon corresponding to at least a portion of the story or illustration depicted in the storybook.

In a particularly preferred embodiment, the structure comprises a plurality of base members, a plurality of vertical poles, each having a first end removably connected to a base member so as to extend vertically therefrom. A plurality of connectors are adapted for removable attachment to a second end of the vertical poles, so as to create the box-like structure. The panels typically comprise at least a rear panel and opposing side panels. A ceiling panel and a front panel may also be provided. In such case, preferably at least one of the panels comprises a material which can be seen through, such as a mesh material. Typically, the panels are slidably connected to the horizontal poles. The structure may also include a floor comprised of a flexible material. Typically, the floor includes graphic representations thereon corresponding to at least a portion of a story or illustration in the storybook.

A three dimensional object is provided which is positionable within the three dimensional structure and corresponding to an object in the storybook. The three dimensional object is preferably removably attachable to a surface of the panels.

Preferably, a bag, which is configured to hold the disassembled poles, panels and base members, is provided so as to store and transport the kit. When the members are removed from the bag and assembled, it enables one or more children to enter into the structure and play therein.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a storybook kit for a child's play structure, generally referred to by the reference number 100. As will be more fully explained herein, the present invention resides in a portable and transportable kit which can be assembled to form a three dimensional play structure which is of a size to permit one or more children to enter therein and play therein. The structure, as will be more fully described herein, includes graphical representations, elements, and objects which relate to a corresponding storybook, which may be provided as part of the kit. As such, the child can view and be read the book, and subsequently play in the play structure and act out the story, or use his or her imagination in expanding upon the story. Thus, the storybook becomes very interactive and more enjoyable to the child.

Figure 2:
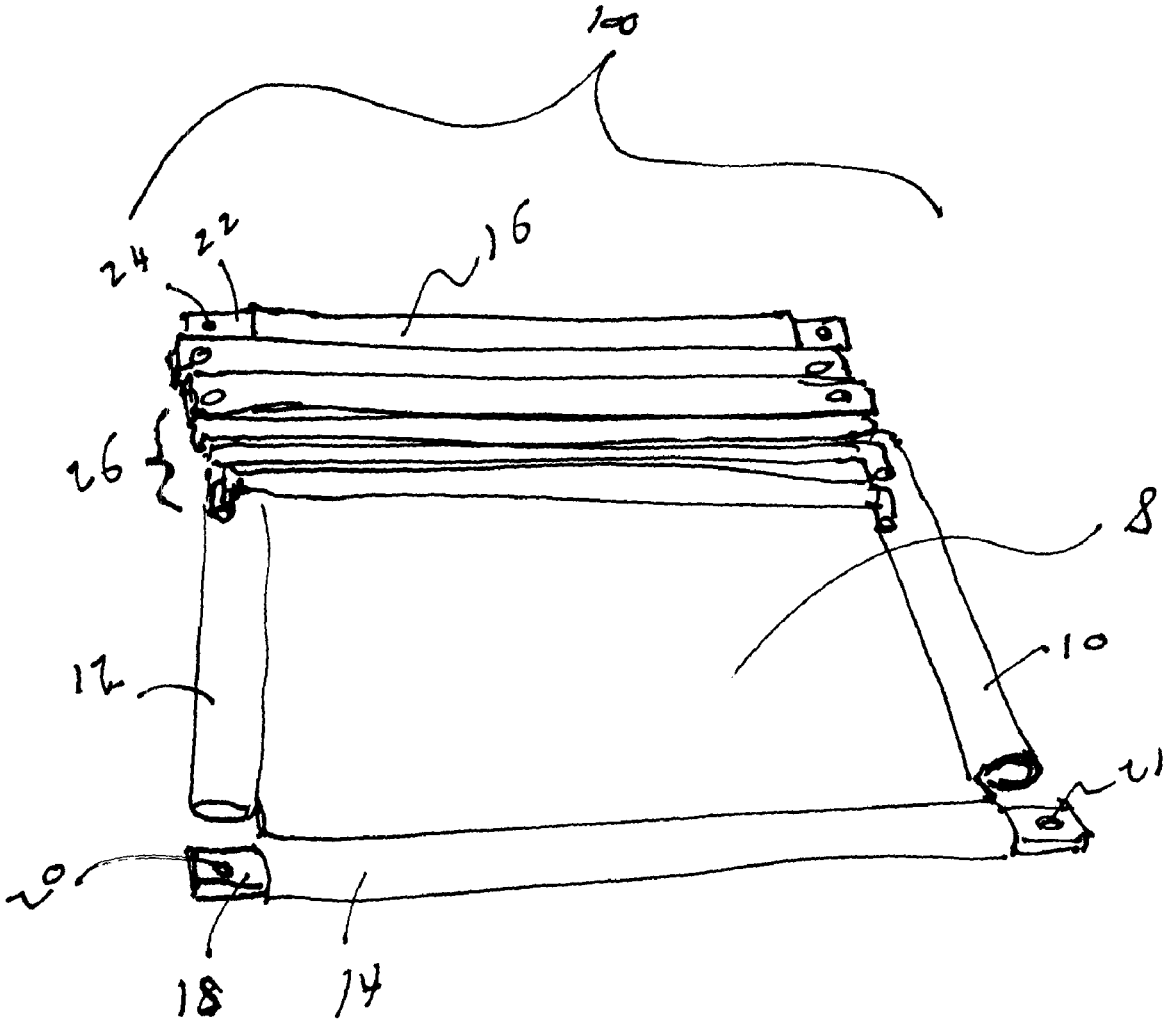
FIG. 2 is a perspective view of the various component parts of the kit of the invention.

With reference now to FIG. 2, various component parts of the kit 100 are illustrated. These include a floor member 8, which typically comprises a flexible material, such as fabric or the like. The floor 8 may include graphic representations thereon corresponding to at least a portion of a story or illustration in the storybook.

Figure 3:
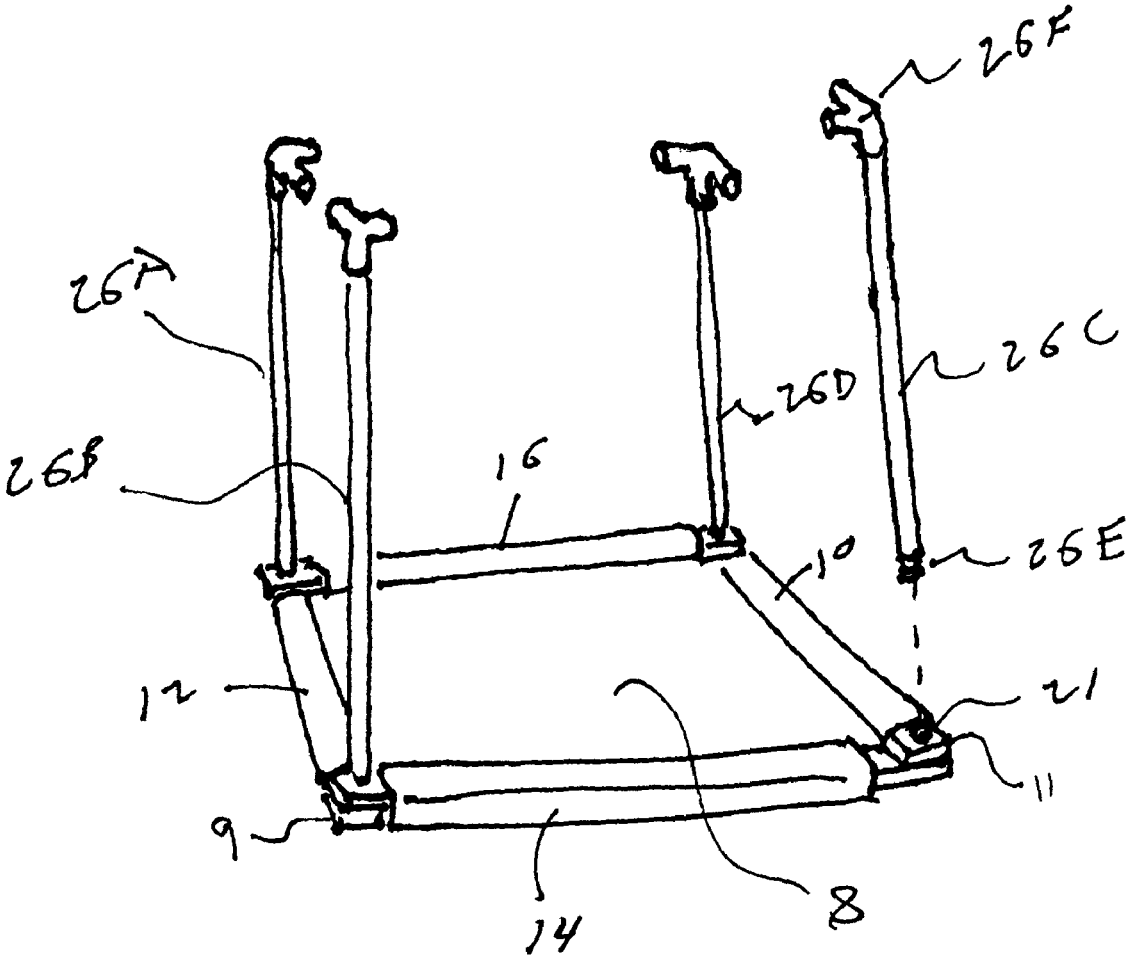
FIG. 3 is a perspective view of various base members and vertical poles, having connectors thereon, assembled in accordance with the present invention.

The kit also includes base members 18 and 22, which may be slid into tubular pockets 14 and 16 at the edge of floor 8. Pockets 10 and 12 accept base plates 9 and 11, as shown in FIG. 3. With continuing reference to FIG. 3, poles 26A-26D are removably attached to the base members, such as via an externally threaded portion 26E, and a mating internally threaded aperture 21 of the base plate members 9-12. Of course, it will be understood that the ends of the poles 26 can be removably attached to the base members by other means, such as by frictional fit or the like. Typically, the support poles 26 are comprised of a PVC pipe or wooden dowels or the like.

Figure 4:
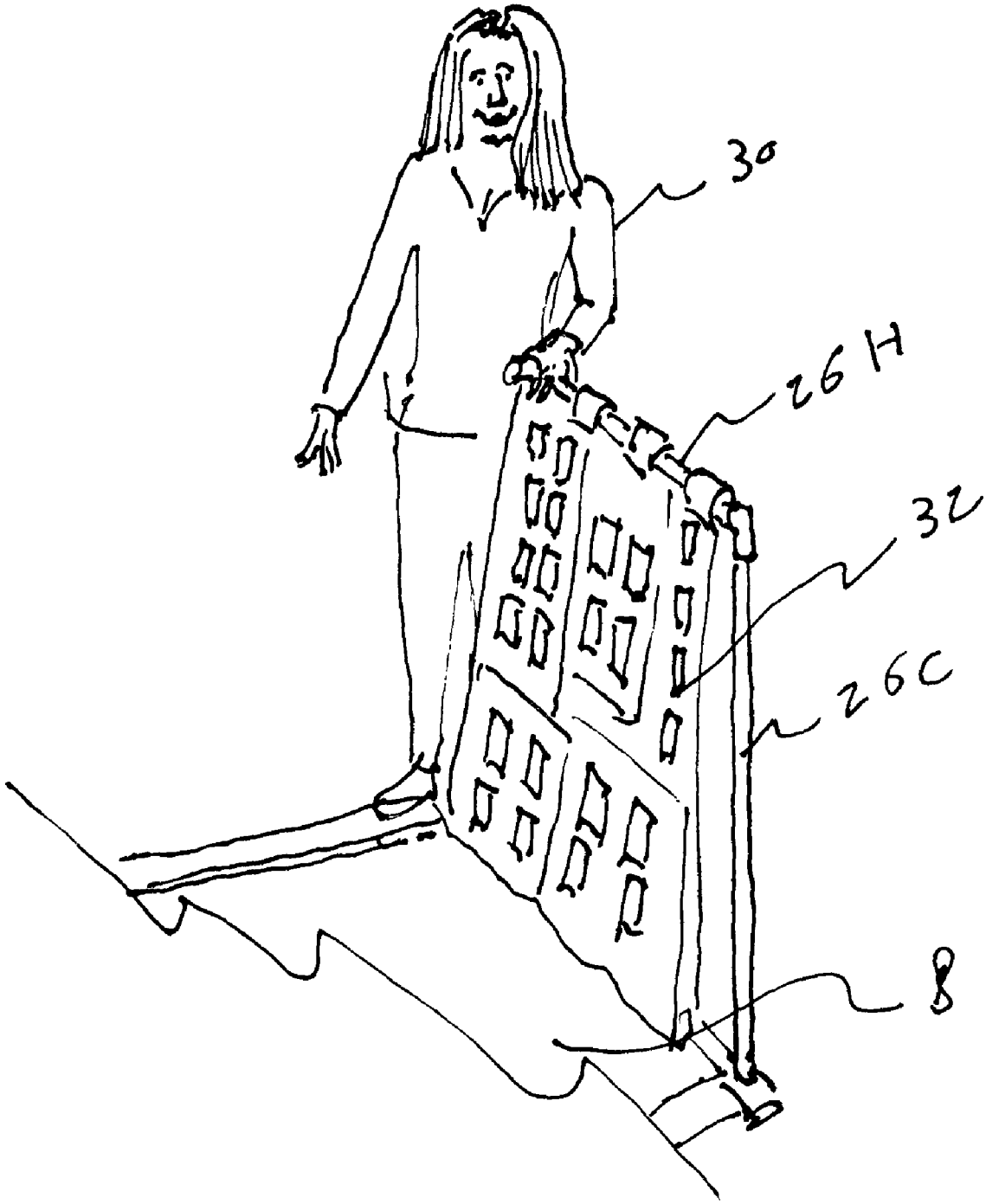
FIG. 4 is an environmental perspective view of one panel in place, in accordance with the present invention.

With reference now to FIGS. 2-4, a plurality of connectors 26F support horizontal poles or rods 26H, as illustrated in FIG. 4. The horizontal poles 26H are connected to the free ends of poles 26A-D by means of the connectors 26F, thus interconnecting the vertical poles to one another and creating a three-dimensional box-like structure of a size to permit a child to fully enter therein. The typical size of the three dimensional structure is shown in FIG. 4, with an adult 30 constructing the structure.

Figure 5:
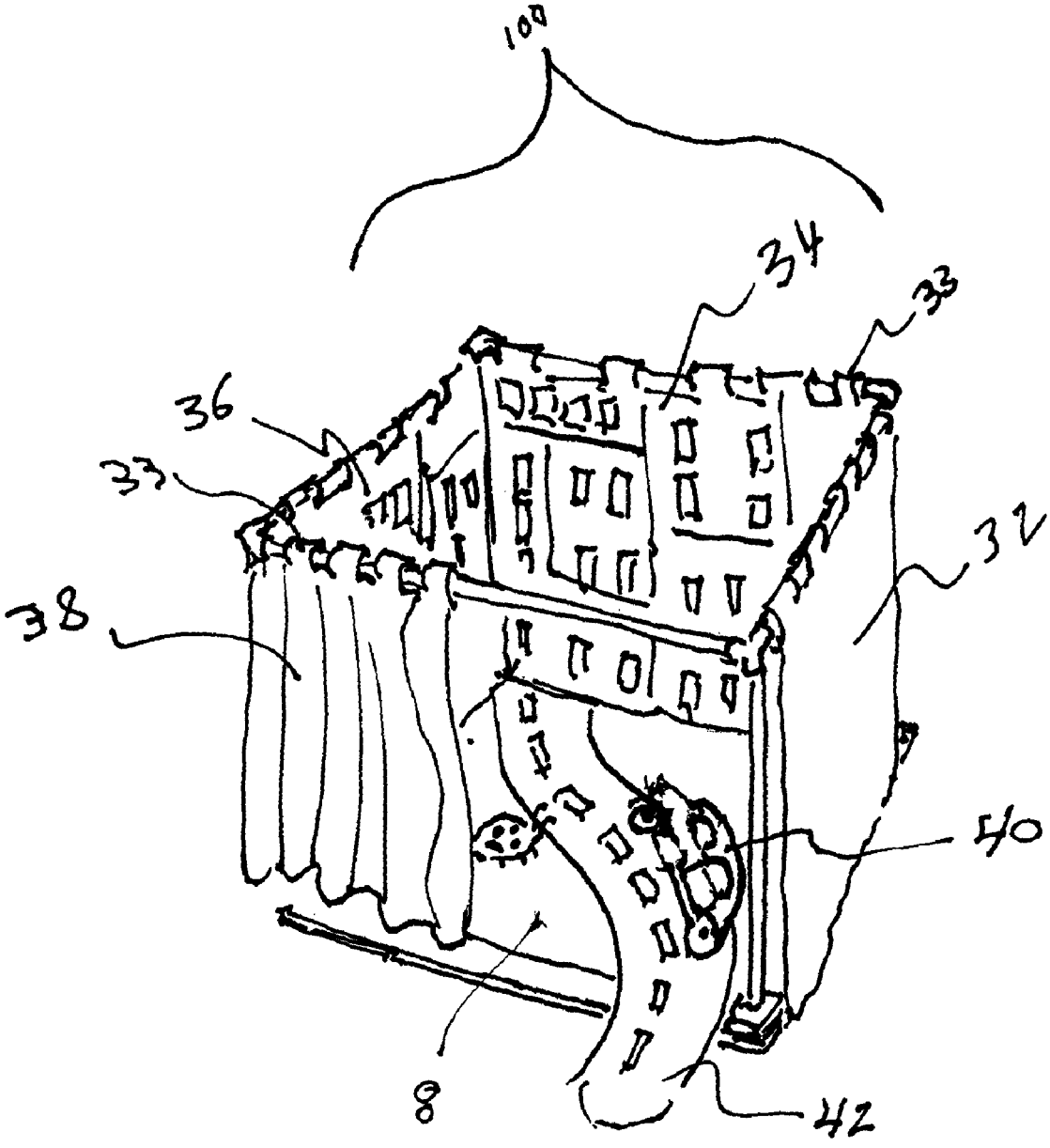
FIG. 5 is a perspective view of the entire child's play structure in an assembled state.
Figure 10:
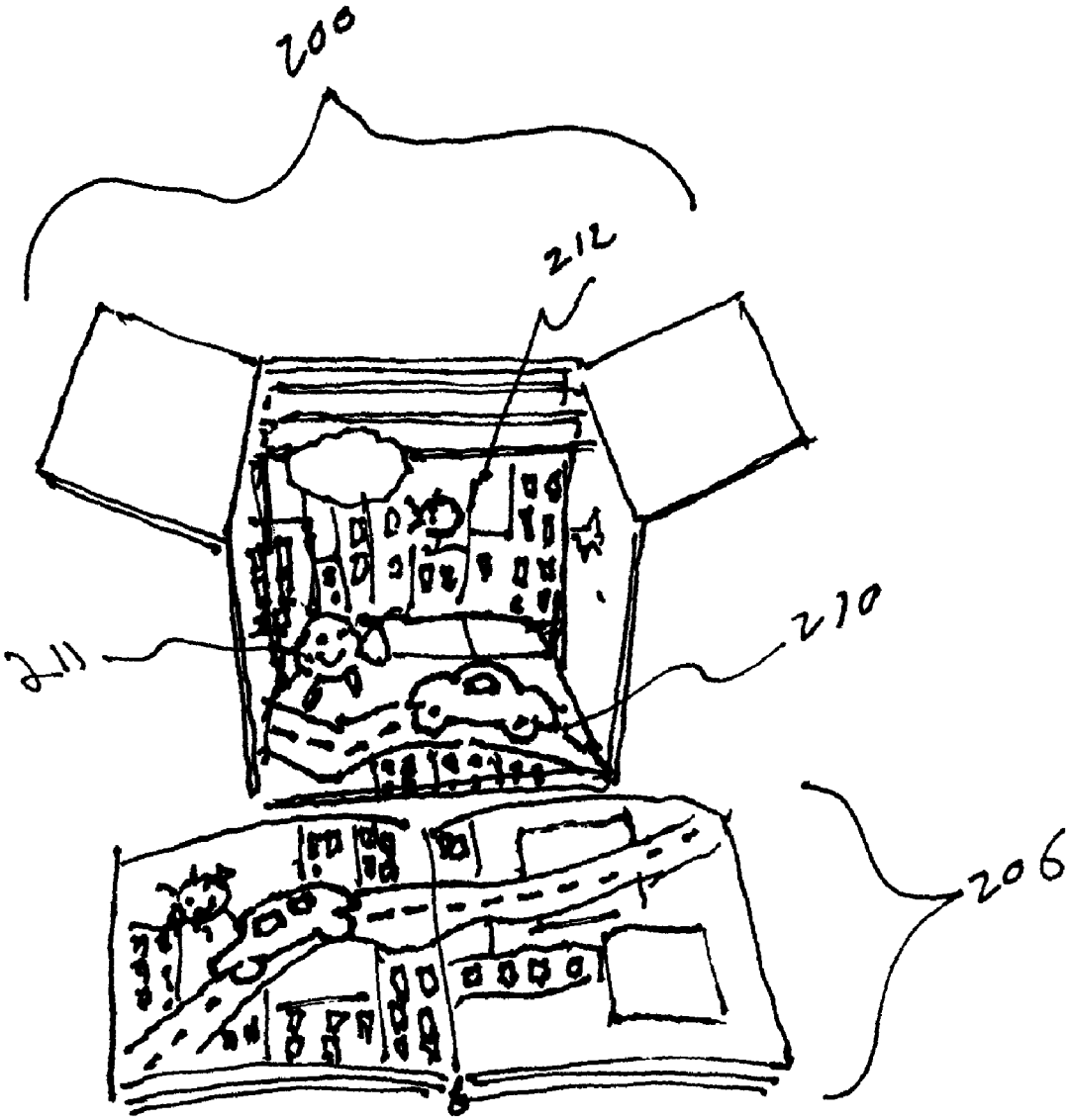
FIG. 10 is a perspective view of a story in progress, in accordance with the present invention.

With reference now to FIGS. 4-5, a plurality of panels 32-38 are provided and attached to the poles. In a particularly preferred embodiment, the panels are comprised of a flexible fabric material, such as felt or the like. Felt material is preferred as it enables graphic elements and objects to be removably attached thereto which are also comprised of felt without any additional means of attachment. However, it will be understood by those skilled in the art that the panels 32-38 can be comprised of any flexible material which is convenient to be broken down and stored and which is portable along with the kit 100. As illustrated in FIG. 4, panel 32 includes graphical representations thereon. These graphical representations correspond to the story, or at least a scene depicted in an illustration of a storybook, such as the storybook 206 illustrated in FIG. 10. With reference to FIG. 10, the illustration covers two pages and includes a city scene, with a road, a car, and a character, in the form of a bug. With reference to FIG. 5, the completed structure 100, created by virtue of assembly of the aforementioned kit, includes graphical representations on the panels which copy and correspond to the illustration and the storybook 206. The city street 42 is provided, which may be a graphical representation on the floor 8, or may be a three dimensional object placed on the floor 8. Moreover, other additional objects such as the car 40 and the bug are positioned with the structure for play by the child. This gives a child who enters into the structure 100 the sensation of being in the story. The objects 40 and 42 can be moved around and manipulated by the child. As mentioned above, the objects 40 and 42 may be removably attached to surfaces of the panels 32-38. Of course, this enhances the overall experience of the storybook. Moreover, the storybook enhances and gives additional meaning to the play structure 100 as well.

With continuing reference to FIG. 5, four panels 32-38 are provided which constitute opposing sides and form four walls and an enclosure to the structure. It will be understood, however, that fewer than four panels can be provided, such as a single rear panel 34 and two adjacent panels 32 and 36 which face one another. However, in a preferred embodiment, the structure includes all four panels to create a box-like and enclosed structure. As mentioned above, the panels 32-38 are removably attached to the poles, and particularly the horizontal poles. Typically, this is done by virtue of loops 33 which receive the horizontal poles 26H therethrough. Moreover, these loops 33 enable the panels 32-38 to be slidably moved so as to permit the child to enter and exit, as illustrated in FIG. 5. In this manner, the child can crawl or walk into the structure.

Figure 6:
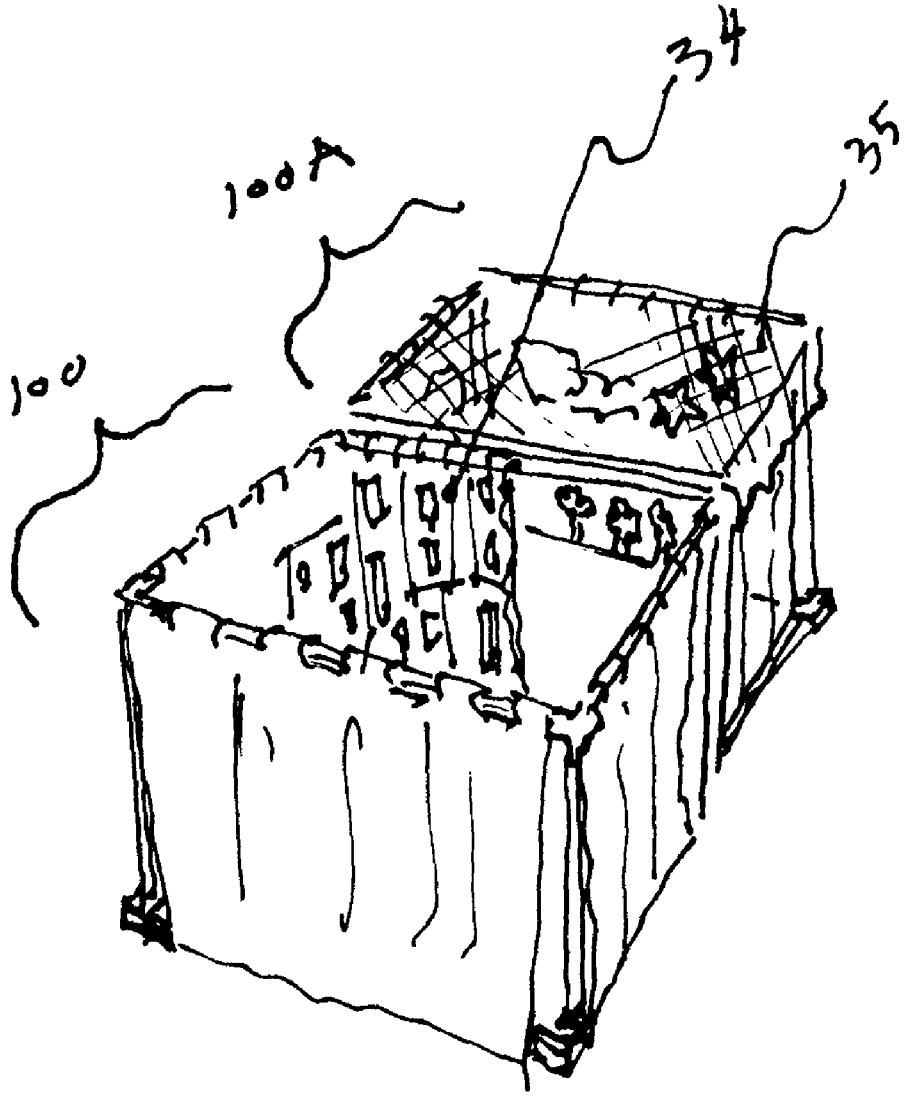
FIG. 6 is a perspective view of two play structures arranged side-by-side, in accordance with the present invention.

With reference now to FIG. 6, two completed structures 100 and 100A are shown disposed adjacent to one another. Typically, structure 100A will illustrate the next phase or page or illustration of the storybook. In this way, the child can crawl or walk through the story in a three dimensional manner, such as by slidably moving the curtain panels, or simply walking or crawling from one structure to another. Of course, this enhances the child's experience of the story and can personalize the story to his or her liking.

Structure 100A is illustrated with a ceiling panel 35. When completely enclosing the structure with panels, preferably at least one panel, such as the ceiling panel 35, is comprised of a material which can be easily seen through, such as a mesh material or the like. This gives the child a sense of full enclosure, but yet reassures the child as the child can still see to the outside world. Of course, this is also reassuring to parents and caretakers.

Figure 7:
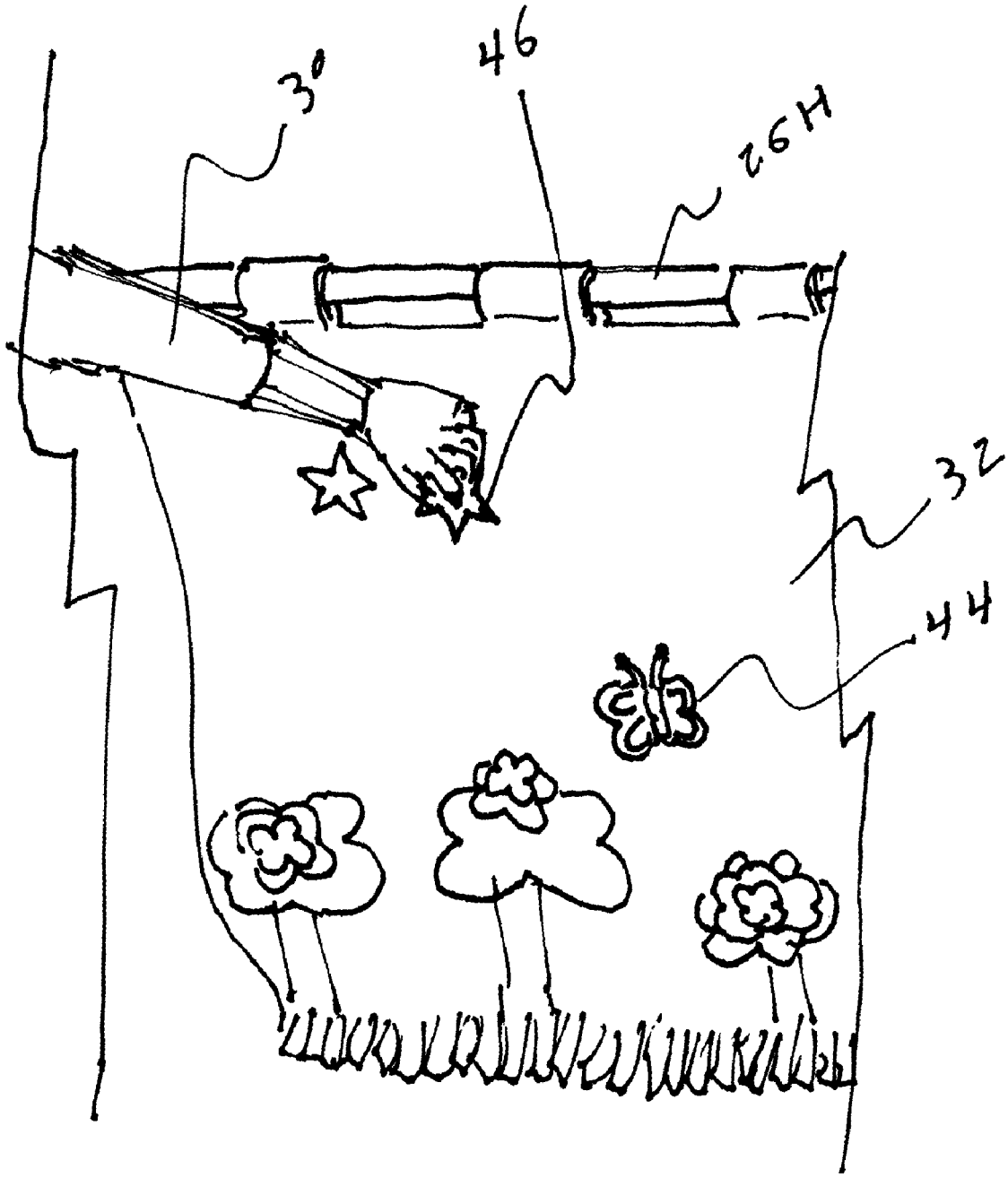
FIG. 7 is a front elevational view of an individual adding an object to a panel, in accordance with the present invention.
Figure 8:
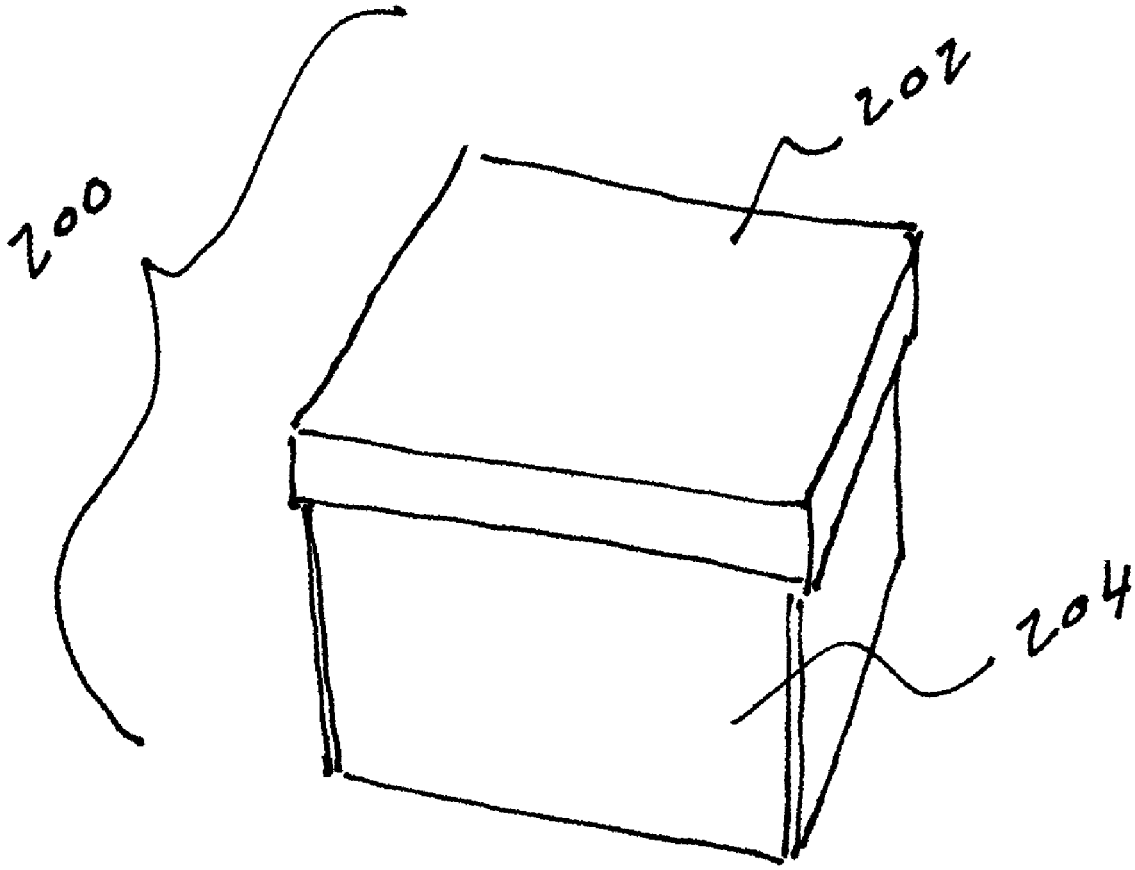
FIG. 8 is a perspective view of an alternative embodiment of the invention constituting a storybook box kit.

With reference now to FIG. 7, additional objects 44 and 46 are shown, these being attached to the inner surface of the panels. Such may comprise felt graphic elements, which are removably attachable to the felt fabric panel 32. Felt has a natural adhesion to itself, so the graphic elements 44 and 46 are removably attached to the panel 32 without need of special adhesives or other attachment means. However, the objects can be removably attached to panels of different materials by different means.

Figure 1:
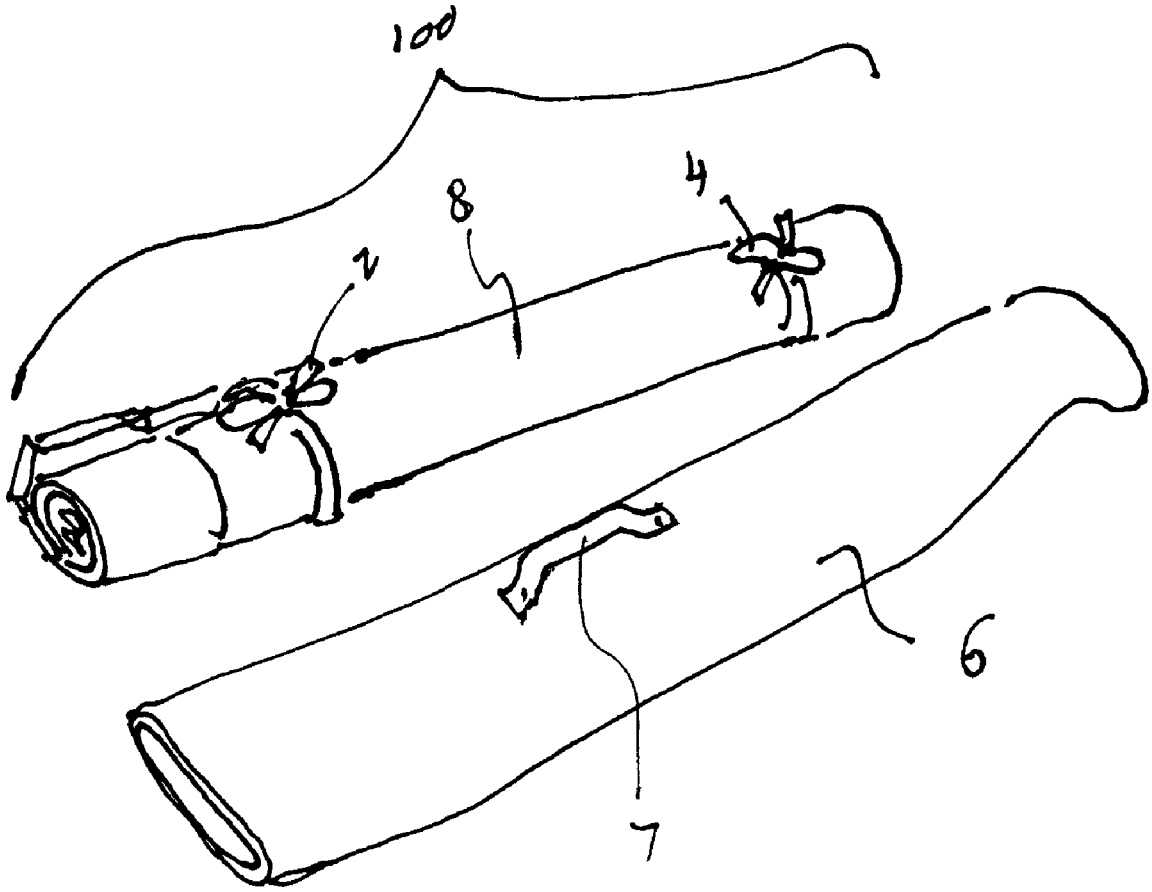
FIG. 1 is a perspective view of the kit in its stored position, and a bag for storing the components thereof.

With reference now to FIG. 1, as mentioned above, the kit is easily stored and transported. This is done by disassembling all of the aforementioned members, and wrapping the poles, base members, and connectors into the floor, ceiling, and wall panel sheets. In FIG. 1, the floor 8 is illustrated as being the outermost rolled member, it being understood that the other components are rolled therein. Ties 2 and 4 can be used to secure the components in a rolled state, after which they are inserted into a bag 6 configured to hold the disassembled components.

Figure 9:
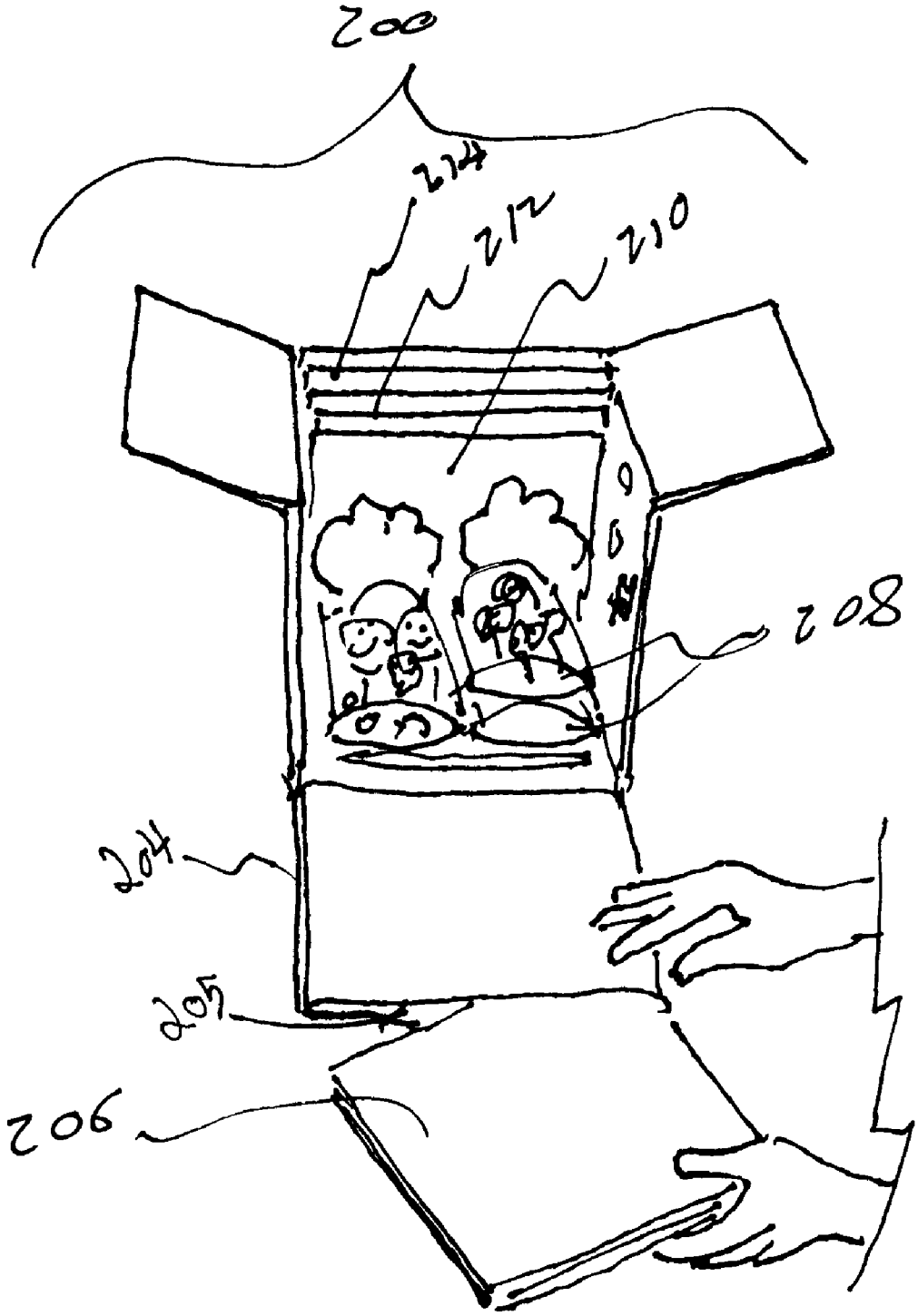
FIG. 9 is a perspective view of the contents of the storybook box kit.

With reference now to FIGS. 8-11, an alternative embodiment of the invention in the form of a kit story box 200 is shown. Instead of being a large crawl-through structure, the structure 200 comprises a box which is of a size so as to be easily carried and placed upon a table or the like. Typically, the box is approximately twelve inches square and has a removable top 202 and sides 204. FIG. 9 illustrates the box 200 in an open position, wherein a front panel 204 thereof is folded down and an individual is pulling out a storybook 206 from a sleeve 205 located on panel 204. The box also has a plurality of rear panels 210-214 which can be moved from an upright position to a downward position, but still within the box structure. The user holds down the rear panels 210-214 sequentially and the back of one panel becomes the floor in the next sequence. For example, the back of panel 210 has become the floor of a city scene in FIG. 10. The scene corresponds to the scene in the two dimensional storybook 206, as described above.

To add to the play value, separate three dimensional elements, such as automobile 210 and bug character 211 are provided, such as in packages 208 which are stored within the box kit 200. The interior walls of the box also include graphic representations of the book, and may be comprised of a material, such as felt, enabling graphic elements to be removably attached to them.

Figure 11:
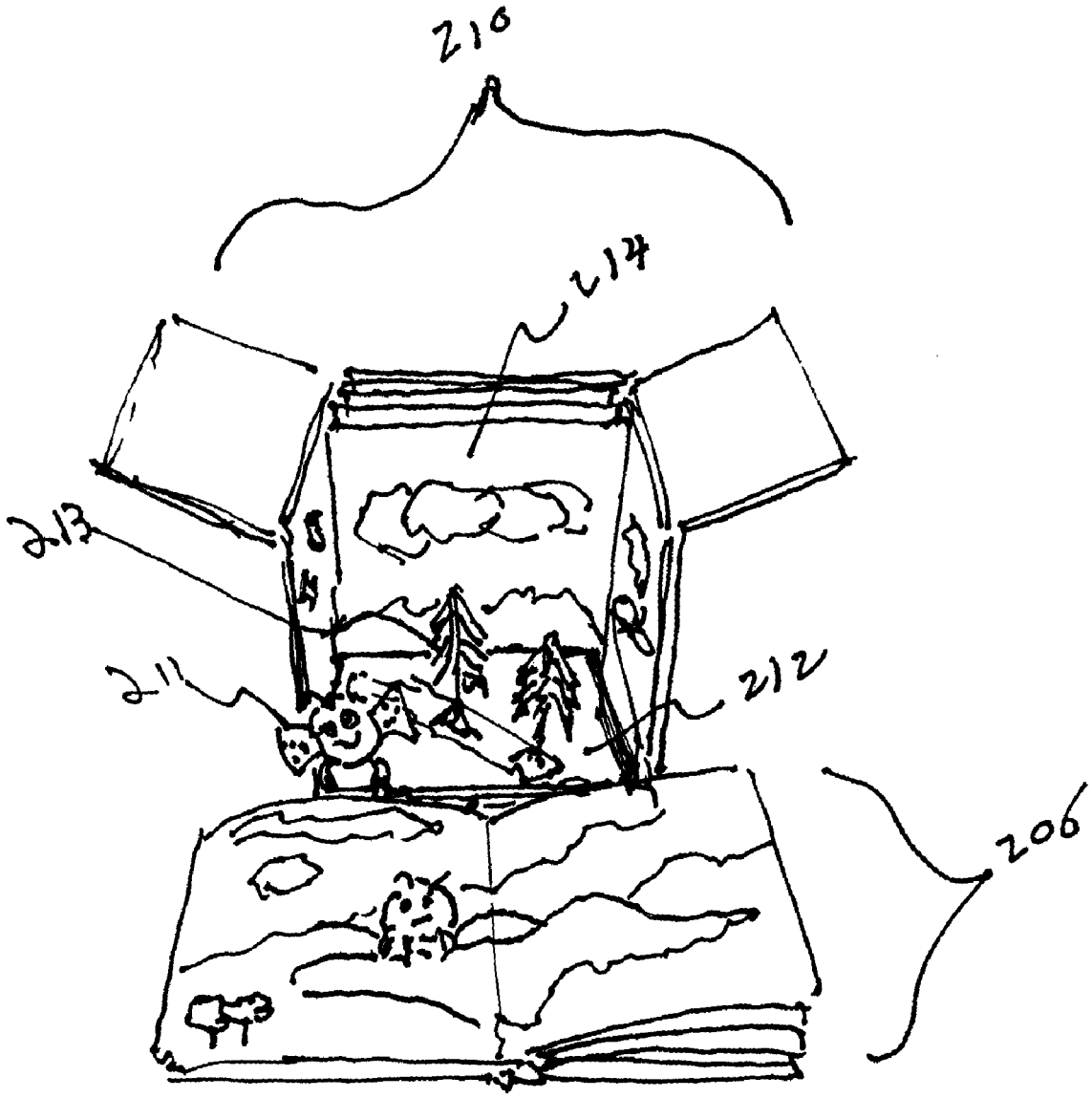
FIG. 11 is an additional perspective view of a story in progress, in accordance with the present invention.

FIG. 11 shows another part of the story where panel 212 has been folded down to become the floor of the scene and panel 214 is now the back wall. In this scene, the bug character 211 is in a country setting similar to that shown in the storybook 206. Three dimensional tree objects 213 add to the realism of the scene.

Although several embodiments have been described in detail for purposes of illustration, various modifications may be made without departing from the scope and spirit of the invention. Accordingly, the invention is not to be limited, except as by the appended claims.

What is claimed is:

1. A kit for a child's storybook play structure, comprising:

a storybook having a plurality of pages including a written story and at least one illustration; and a structure including poles removably attached to one another and arranged to form a three-dimensional box-like structure of a size to permit a child to fully enter therein, and a plurality of panels attached to the poles, wherein at least one of the panels has graphic representations thereon corresponding to at least a portion of the story or illustration depicted in the storybook;

wherein the panels comprise a rear panel and an opposing panel, and another set of opposing side panels, at least one of the panels comprising a material which can be seen through.

2. The kit of claim 1, wherein the structure comprises a plurality of base members, a plurality of vertical poles, each having a first end removably connected one of the plurality of base members so as to extend vertically therefrom, a plurality of connectors adapted for removable attachment to a second end of the vertical poles, a plurality of horizontal poles, the first and second ends of the horizontal poles removably connected to the connectors, and the plurality of panels removably attached to the poles.

3. The kit of claim 2, wherein the panels are slidably connected to the horizontal poles.

4. The kit of claim 2, including a bag configured to hold the disassembled poles, panels, and base members.

5. The kit of claim 1, including a three dimensional object positionable within the three dimensional structure and corresponding to an object in the storybook.

6. The kit of claim 1, including an object corresponding to an object in the storybook removably attachable to the panels.

7. The kit of claim 1, wherein the structure includes a floor comprised of a flexible material.

8. The kit of claim 7, wherein the floor includes graphic representations thereon corresponding to at least a portion of a story or illustration in the storybook.

9. A method for assembling a child's storybook play structure, comprising the steps of:

providing a plurality of base members;

attaching a first end of vertical poles to the base members;

attaching horizontal poles to the vertical poles so as to interconnect the vertical poles to create a structure sized to permit a child to fully enter therein;

providing a plurality of panels, at least one having graphic representations thereon corresponding to a story or illustration of a related storybook;

attaching the plurality of panels to the poles to form walls to the structure; and a child entering into the structure and playing therein; and arranging a sheet of material on the base of the structure to create a floor, the sheet of material having graphic representations thereon corresponding to the storybook.

10. The method of claim 9, wherein the panels are comprised of a flexible fabric material.

11. The method of claim 9, including the step of providing an object to be positioned within the structure and played with by the child, wherein the object corresponds to an object in the storybook.

12. The method of claim 11, including the step of removably attaching the object to a surface of a panel.

13. A kit for a child's storybook play structure, comprising:

a storybook having a plurality of pages including a written story and at least one illustration;

a structure including poles removably attached to one another and arranged to form a three-dimensional box-like structure of a size to permit a child to fully enter therein, and a plurality of panels attached to the poles, wherein at least one of the panels has graphic representations thereon corresponding to at least a portion of the story or illustration depicted in the storybook;

wherein the panels comprise a rear panel and opposing side panel; and wherein the panels comprise a ceiling panel and another set of opposing side panels, at least one of the panels comprising a material which can be seen through.

14. A kit for a child's storybook play structure, comprising:

a storybook having a plurality of pages including a written story and at least one illustration;

a structure including poles removably attached to one another and arranged to form a three-dimensional box-like structure of a size to permit a child to fully enter therein, and a plurality of panels attached to the poles, wherein at least one of the panels has graphic representations thereon corresponding to at least a portion of the story or illustration depicted in the storybook;

wherein the structure includes a floor comprised of a flexible material; and wherein the floor includes graphic representations thereon corresponding to at least a portion of a story or illustration in the storybook.

15. A kit for a child's storybook play structure, comprising:

a storybook having a plurality of pages including a written story and at least one illustration; and a structure including poles removably attached to one another and arranged to form a three-dimensional box-like structure of a size to permit a child to fully enter therein, and a plurality of panels attached to the poles, wherein at least one of the panels has graphic representations thereon corresponding to at least a portion of the story or illustration depicted in the storybook;

wherein the structure includes a floor comprised of a flexible material including graphic representations thereon corresponding to at least a portion of a story or illustration in the storybook.

16. The kit of claim 15, wherein the structure comprises a plurality of base members, a plurality of vertical poles, each having a first end removably connected one of the plurality of base members so as to extend vertically therefrom, a plurality of connectors adapted for removable attachment to a second end of the vertical poles, a plurality of horizontal poles, the first and second ends of the horizontal poles removably connected to the connectors, and the plurality of panels removably attached to the poles.

17. The kit of claim 16, wherein the panels are slidably connected to the horizontal poles.

18. The kit of claim 16, including a bag configured to hold the disassembled poles, panels, and base members.

19. The kit of claim 15, wherein the panels comprise a rear panel and opposing side panels.

20. The kit of claim 19, wherein the panels further comprise a ceiling panel, at least one of the panels comprising a material which can be seen through.

21. The kit of claim 15, including a three dimensional object positionable within the three dimensional structure and corresponding to an object in the storybook.

22. The kit of claim 15, including an object corresponding to an object in the storybook removably attachable to the panels.

* * * * *